US012649504B2

(12) United States Patent
Tripathy et al.

(10) Patent No.: US 12,649,504 B2
(45) Date of Patent: Jun. 9, 2026

(54) VEHICLE SYSTEM AND METHOD

(71) Applicant: Transportation IP Holdings, LLC, Norwalk, CT (US)

(72) Inventors: Janmejay Tripathy, Cedar Rapids, IA (US); Andrew Ryan Staats, Cedar Rapids, IA (US); Timothy Allen Schultz, Marion, IA (US); Milan Karunaratne, Orange, CA (US); Evan Sevel, Pittsburgh, PA (US); Adam Hausmann, Melbourne, FL (US); Larry Chalmers, Jacksonville, FL (US); Alan Fisher, Philadelphia, PA (US); Amit Kenjale, West Melbourne, FL (US); Benjamin Henniges, Mount Airy, MD (US); Daniel Spencer, Melbourne, FL (US); Danial Rice, Point of Rocks, MD (US)

(73) Assignee: Transportation IP Holdings, LLC, Norwalk, CT (US)

( * ) Notice: Subject to any disclaimer, the term of this patent is extended or adjusted under 35 U.S.C. 154(b) by 430 days.

(21) Appl. No.: 18/120,275

(22) Filed: Mar. 10, 2023

(65) Prior Publication Data

US 2023/0211817 A1 Jul. 6, 2023

Related U.S. Application Data

(63) Continuation-in-part of application No. 17/237,686, filed on Apr. 22, 2021, now Pat. No. 11,834,023, and (Continued)

(51) Int. Cl.
*B61L 15/00* (2006.01)
*B61L 25/04* (2006.01)
(Continued)

(52) U.S. Cl.
CPC ..... *B61L 15/0027* (2013.01); *B61L 25/04* (2013.01); *B61L 27/04* (2013.01); *B61L 27/20* (2022.01);
(Continued)

(58) Field of Classification Search
None
See application file for complete search history.

(56) References Cited

U.S. PATENT DOCUMENTS 6,828,746 B2 12/2004 Kumar
11,673,561 B2 * 6/2023 Claussen ..... B61L 27/40 701/58
(Continued)

OTHER PUBLICATIONS

"The Railway Safety Act of 2023", Senators Brown, Vance, Casey, Rubio, Fetterman, and Hawley (2 pages).
(Continued)

*Primary Examiner* — Peter D Nolan
*Assistant Examiner* — Michael F Whalen
(74) *Attorney, Agent, or Firm* — K&L Gates LLP

(57) ABSTRACT

In one example, a wayside device monitoring system is provided. The system may include a wayside device and a controller. The wayside device may detect one or more operating parameters of a vehicle in a vehicle system moving over a route segment. The controller can receive information from the wayside device regarding at least the one or more operating parameters detected, and can control movement the vehicle directly or indirectly based at least in part on the received information.

21 Claims, 5 Drawing Sheets

Related U.S. Application Data a continuation-in-part of application No. 17/181,667, filed on Feb. 22, 2021, now Pat. No. 11,987,276, and a continuation-in-part of application No. 16/399,019, filed on Apr. 30, 2019, now Pat. No. 11,691,657.

(51) Int. Cl.
*B61L 27/04* (2006.01)
*B61L 27/20* (2022.01)
*B61L 27/57* (2022.01)

(52) U.S. Cl.
CPC ..... *B61L 27/57* (2022.01); *B61L 2201/00* (2013.01); *B61L 2205/00* (2013.01)

(56) References Cited

U.S. PATENT DOCUMENTS

2010/0258682 A1 10/2010 Fries et al.
2016/0039439 A1* 2/2016 Fahmy ..... B61L 15/0081 701/20
2016/0189552 A1* 6/2016 Hilleary ..... B61L 29/22 246/125
2018/0257683 A1 9/2018 Govindappa et al.
2019/0193759 A1* 6/2019 Ravi ..... G07C 5/085
2021/0134081 A1 5/2021 Claussen et al.
2022/0266883 A1 8/2022 Tripathy

OTHER PUBLICATIONS

U.S. DOT "Effectiveness of Wayside Detector Technologies on Train Operation Safety", Federal Railroad Administration, Office of Research, Development and Technology, Washington DC, May 2022 (61 pages).
Wiedmann, "As Railroad Systems Advance, Wayside Signals Fade Away" https://insights.burns-group.com/2021/07/29/as-railroad-systems-advance-wayside-signals-fade-away/ (7 pages).
U.S. DOT "An Implementation Guide for Wayside Detector Systems" Federal Railroad Administration, Office of Research, Development and Technology, Washington DC, May 2019 (99 pages).
European Search Report for corresponding EP24158596.7, dated Jul. 20, 2024.

* cited by examiner

VEHICLE SYSTEM AND METHOD

CROSS-REFERENCE TO RELATED APPLICATIONS

This application is a continuation-in-part of and claims priority to U.S. patent application Ser. No. 17/181,667 (filed 22 Feb. 2021), U.S. patent application Ser. No. 16/399,019 (filed 30 Apr. 2019), and U.S. patent application Ser. No. 17/237,686 (filed 22 Apr. 2021), the contents of which are incorporated by reference herein in their entirety.

BACKGROUND

Technical Field

The subject matter described herein relates to systems and methods for vehicle control.

Discussion of Art

Some vehicles have vehicle control systems that may operate some of their various parameters, such as speed, direction, and the like. This may be done under manual control of an operator, remote control by an operator, semi-autonomously with an operator, or autonomously without an operator. Autonomous controls can include a positive vehicle control (PVC) system, such as I-ETMS positive train control system and an energy management system (e.g., Trip Optimizer system) both available from Wabtec Corporation. Under I-ETMS, a rail vehicle cannot proceed onto a track segment without permission (in the form of a Movement Authority) and even then there may be restrictions on such movement (in the form of a Bulletin) that acts beyond established speed limits set for that track segment. Communications Based Train Control (CBTC) may control operation of the vehicle in some applications.

Some wayside devices operate to ensure safe travel of vehicle systems, and other wayside devices operate to monitor operation of the vehicle systems. For example, wayside devices may include sensors that sense one or more characteristics of the vehicle systems (e.g., hot box detectors, cameras, etc.) and/or the surrounding environment. These wayside devices may record data related to or generated from the operation of the wayside devices. In some instances, the wayside devices may have a consistent connection to a communication network or may have the ability to connect to a communication network on demand. But some wayside devices may have no connection to any communication network, or may not be able to connect to any such communication network on demand. For example, some wayside devices at remotely located intersections may not have a network connection due to the lack of surrounding infrastructure.

An operator may need to travel to the location of the wayside device, physically connect a data recorder of the wayside device with a computer carried by the operator, download the data from the data recorder of the wayside device to the operator computer, and then return to a remote location having a communication network connection to upload the data to other systems, such as a back office of a Positive Vehicle Control (PVC) system. It may be desirable to have a system and method that differs from those that are currently available.

BRIEF DESCRIPTION

In one example, a wayside device monitoring system is provided that may include a wayside device and a controller.

The wayside device may detect one or more operating parameters of a vehicle in a vehicle system moving over a route segment. The controller can receive information from the wayside device regarding at least the one or more operating parameters detected and can control movement the vehicle directly or indirectly based at least in part on the received information.

According to one aspect, a system is provided that includes a wayside device and a controller. The wayside device can detect one or more operating parameters of a vehicle in a vehicle system moving over a route segment. The controller can: receive information from the wayside device regarding at least the one or more operating parameters detected, and alert first responders of a scheduled travel of the vehicle system carrying hazardous cargo in advance of the vehicle entering a route segment for which the first responders are responsible, or upon the entry of the vehicle into the route segment for which the first responders are responsible.

According to one aspect, a system is provided that includes a wayside device and a controller. The wayside device can detect one or more operating parameters of a vehicle in a vehicle system moving over a route segment. The controller can: receive information from the wayside device regarding at least the one or more operating parameters detected, and determine which of friction brakes, dynamic braking, or both to respond to a determination of an anomalous operation of a railcar component, and control movement the vehicle directly or indirectly based at least in part on the information that is received from the wayside device.

BRIEF DESCRIPTION OF THE DRAWINGS

The subject matter may be understood from reading the following description of non-limiting embodiments, with reference to the attached drawings, wherein below.

DETAILED DESCRIPTION

Figure 1:
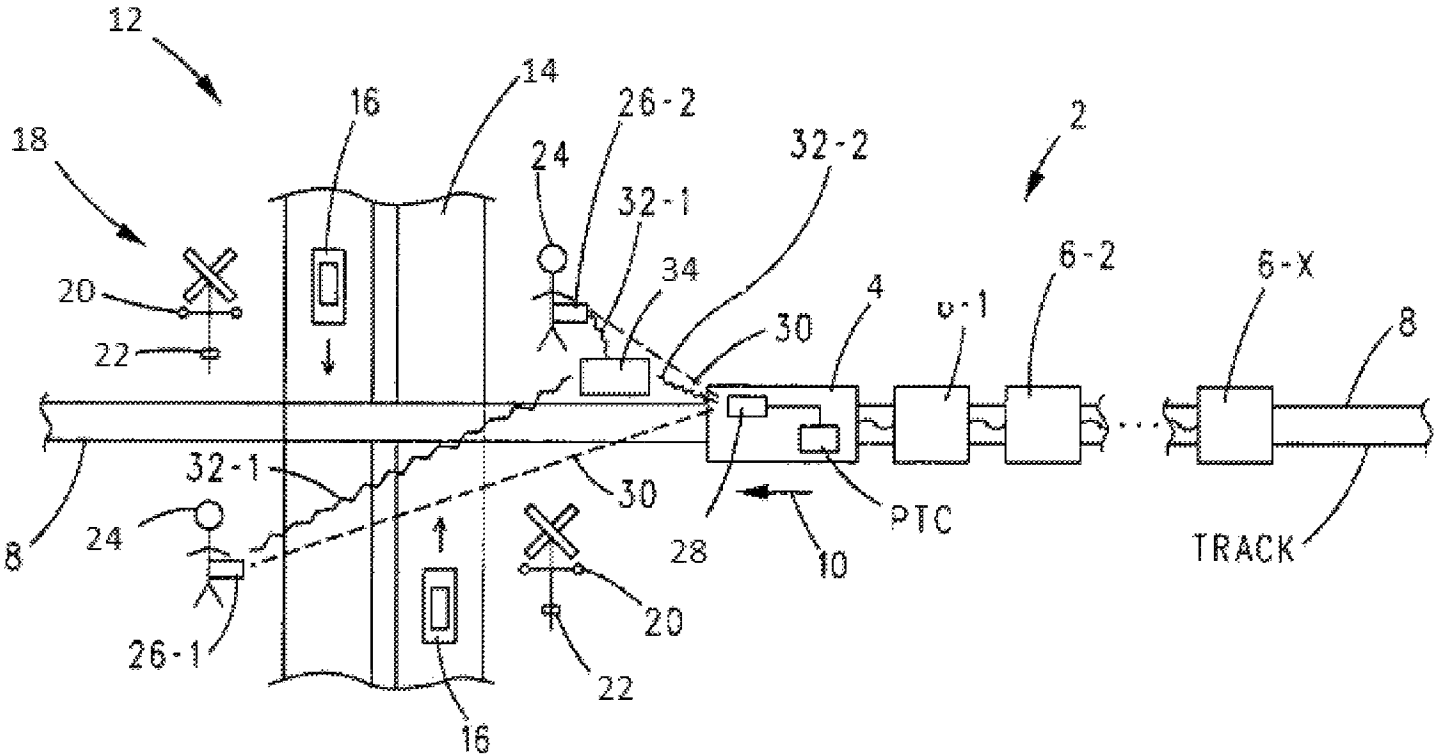
FIG. 1 is a diagram showing an example of a system according to an embodiment of the inventive subject matter.

Embodiments of the subject matter described herein relate to systems and methods that allow for the communication or acquisition of data from devices that may not have regular or consistent connections to communication networks, as well as the communication and/or use of that data to or by other systems for diagnosis of the devices, control of the devices, control of other systems, etc. In one example, the system and methods may use already installed system components onboard many, if not almost all, rail vehicle systems traveling in the United States. Suitable system components may include the I-ETMS positive train control system, Trip Optimizer system (both available from Wabtec Corporation), Electronically controlled pneumatic (ECP) brake systems, and the like. These vehicle systems may have a wireless interface (e.g., WiFi), which may be used to upload the data obtained from wayside devices once the vehicle systems reach a vehicle yard (e.g., rail yard) or other location that has a consistent or reliable connection to a communication network (e.g., MESH, LAN, WAN). A suitable controller may be integrated with or communicatively couple to other local or interchangeable database management systems, such as the InteRRIS system, EHMS, UMLER, or other similar systems. Trademarks belong to their respective owners.

The system may include a communication device such as a WiFi access point at the wayside device on a data recorder. This communication device can allow the communication device onboard the vehicle system (e.g., the WiFi interface) to connect to the data recorder and upload the data of the wayside device to the vehicle system. The vehicle system then moves that data over the existing upload interface to the back office prior to reaching a vehicle yard or upon arriving at the vehicle yard. Optionally, a communication device that includes a WAN circuit or a modem plus a cellular subscription, may be installed at the wayside device to allow the wayside device to upload the data to the back office system without having to first communicate the data to the vehicle system. In one embodiment, plural wayside devices are installed at periodic intervals along the route, and each has a communication device that is configured to communicate at least as far as needed to contact the wayside device on either of its sides along the route. The wayside devices may then establish a network, such as a mesh network, in place of or in addition to, any other communication pathways available to the wayside devices.

The subject matter described herein extends to plural types of vehicle systems, such as automobiles, trucks (with or without trailers), buses, marine vessels, aircraft, mining vehicles, agricultural vehicles, or other off-highway vehicles. The vehicle systems described herein (rail vehicle systems or other vehicle systems that do not travel on rails or tracks) may be formed from a single vehicle or multiple vehicles. With respect to multi-vehicle systems, the vehicles may be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together (e.g., as a convoy).

With reference to FIG. 1, in one embodiment, a vehicle system 2 includes a powered vehicle 4 and may include any number of non-powered cars 6-1-6-X (including zero cars). In the example, the vehicle system shown in FIG. 1 is a train, the powered vehicle is a locomotive, and the non-powered vehicles are rail cars. The powered vehicle may be considered as the master or lead vehicle of the train and the rail car 6-X is the last vehicle of the vehicle system and may be a trail unit or slave. Depending on the application, the vehicles can be positioned in the vehicle system, the direction of travel of the vehicle system may change (thus reversing the lead and trail designation).

In the example shown in FIG. 1, the vehicle system is traveling on a route 8. The route in this example is a rail the route in a direction of arrow 10 toward an at-grade crossing 12. In one embodiment, the crossing can be the intersection of rail tracks and a road or roadway 14 on which one or more other vehicles 16 can travel. Other permutations that are not shown may include crossing roads, crossing tracks, a road and track crossing, more than two routes crossing, one of the routes being a pedestrian route, and the like. In some embodiments, travel into or through a segment of the route (that may or may not include a crossing) is interchangeable with a crossing as discussed here.

In one embodiment, the crossing or route segment can have a co-located health and warning wayside system 18. In one embodiment, wayside system can include some or all of the following: one or more visual indicators 20, an audible indicator 22, a selectively deployable physical barrier, a communication device, and a sensor package (not shown in FIG. 1. A suitable visual indicator may include a light, such as a red light, an illuminating arrow, illuminated text information, and other graphics. A suitable audible indicator may be a bell, a speaker, a siren, and the like. A suitable barrier may be a crossing gate. The wayside system may operate such that when the vehicle system is a first distance from the crossing, the visual indicators can commence flashing and the audible indicator can commence sounding. When the vehicle system moves to a second, closer distance to the crossing, any crossing gates of wayside system can lower at least partially across the roadway to block the travel of vehicle(s) over the route. In one embodiment, the flashing of visual indicators and the sounding of audible indicator can, in an example, be activated about 30 seconds before the vehicle system arrives at the crossing, assuming the vehicle system is traveling at rated track speed. In one embodiment, any optional crossing gates of wayside system can be lowered in a determined amount of time, such as about 15 to 20 seconds before the vehicle system arrives at the crossing, again assuming the vehicle system is traveling at rated track speed. If a train is traveling at a greater than or less than a rated track speed, the time visual indicators and audible indicator are activated and/or time optional crossing gates are lowered before the vehicle system arrives at the crossing may be decreased or increased accordingly.

Other wayside system components may include various detectors and sensors, as discussed further herein, and may include a communication device that can transmit information to a back office system, one or more vehicles in the vehicle system, personnel located nearby, other wayside devices, and the like. The wayside device may be located distal to a crossing. The location may be along a length of the route, at some item of infrastructure along the route, and the like. Infrastructure may include the crossing or intersection, discussed in detail, and may include bridges, tunnels, switches, and the like.

In one embodiment, when the wayside system or a part thereof malfunctions, one or more human repair crew, line crew, ground crew, inspectors, and/or flaggers 24 (collectively referred to as line crew) may be stationed or positioned at or proximate the crossing. A flagger may help the vehicles move safely across the route. A member of the line crew may carry a portable wireless communication device 26 that the line crewman may use to wirelessly communicate data to a wireless receiver or transceiver 28 provided onboard a vehicle. This may be done directly via a wireless communication channel 30 between the portable communication device and onboard communication device, or indirectly via a wireless communication channel 32 that uses a wireless wayside transceiver communication device 34. In an example, the wireless communication channel between the portable communication device and wireless onboard communication device can include a first portion 32-1 between the portable communication device and wireless wayside transceiver, and a second portion 32-2 between wireless wayside transceiver and wireless onboard communication device.

Where two or more wireless devices communicate data with wireless onboard communication device via the wayside communication device, second portion 32-2 of the communication channel can include data included on the first portion 32-1 of the communication channel output by each portable communication device. That is, the wayside communication device can transform, check, and communicate the data from two or more wireless devices to onboard communication device, which can recognize the data being transmitted by each portable communication device separately from each other the portable communication device. Other features may include validation checks, encryption/decryption, authentication checks, and the like.

In one embodiment, the particular wireless protocol utilized for the first portion 32-1 of the channel can be selected. In one embodiment, the wireless protocol can be WiMAX, a wireless local loop (WLL), a Zigbee wireless mesh network, Bluetooth, and the like. However, this is not to be construed in a limiting sense since it is envisioned that any suitable and/or desirable wireless protocol may be utilized for communication between the wayside communication device and each portable communication device.

In one embodiment, where the channel is used by the portable communication device to communicate directly with wireless onboard communication device, the channel can, in an example, include one or more frequencies at a sufficient power level to enable communication when wireless onboard communication device is at least the first distance away from the crossing. In an example, this first distance can be a distance where the vehicle system traveling at rated track speed toward the crossing is about 30 seconds away from the crossing. In one embodiment, the frequencies utilized by the channel can include at least a portion of the VHF radio spectrum, and, more particularly, frequencies from 220 MHz to 225 MHz. In one embodiment, the channel, the channel, first portion 32-1 of the channel, and/or second portion 32-2 of the channel can be implemented via a cellular telephone network. In this example, one, or two, or more of the wayside communication device, a first transceiver 60, and/or a second transceiver 74 can be realized by a cellular radio. Suitable transceivers can be radio frequency (RF) capable.

In one embodiment, where each of two or more wireless devices are deployed proximate the crossing, each portable communication device can be programmed or configured with a unique identifier that enables wireless onboard communication device to distinguish a signal output by the portable communication device from a signal output by another the portable communication device. In this way, each signal output by each portable communication device on the channel and/or the channel can include the unique identifier from which wireless onboard communication device can determine which the portable communication device output the signal from each other the portable communication device that may be able to communicate with wireless onboard communication device.

Figure 2:
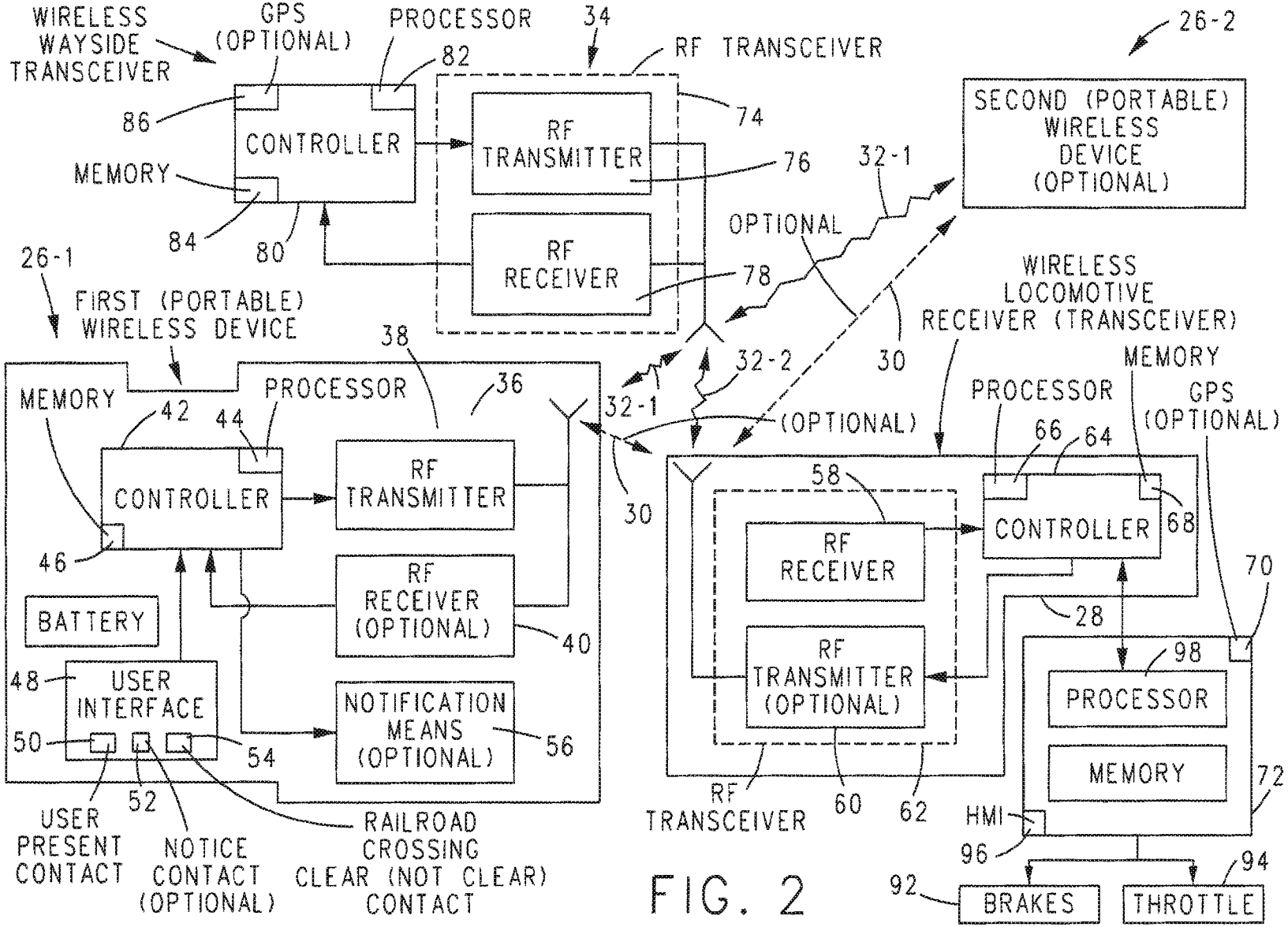
FIG. 2 is a block diagram showing an example of a system according to an embodiment of the inventive subject matter.

With reference to FIG. 2 and with continuing reference to FIG. 1, in one embodiment a vehicle control system in accordance with an embodiment of the inventive subject matter can include the first portable communication device-1 and an optional the second portable communication device-2. The line crewman can be equipped with or carry the portable communication device. In one embodiment, each portable communication device can include a transmitter 38 and an optional receiver 40. The transmitter and receiver, when provided together, can comprise an RF transceiver that functions as a communication device 36.

In one embodiment, each communication device can include or can communicate with a controller 42. The controller may include a processor 44 and memory 46. A suitable communication device can have a user interface 48 or human machine interface (HMI) coupled to provide user input to the controller from a line crewman utilizing the portable communication device. In one embodiment, the HMI can include a "user present" contact or switch 50, an optional "notice" contact or switch 52, and a "crossing clear" contact or switch 54. In one embodiment, each portable communication device can include a notification device 56. A suitable notification device can be a visual indicator, a haptic feedback device, a speaker, and the like.

In one embodiment, wireless onboard communication device can include a receiver 58 and a transmitter 60 that, provided together, can define a transceiver 62 that in turn can be a wireless onboard communication device. The onboard communication device can include a controller 64. The controller can include a processor 66 and a memory 68. The controller can, among other things, demodulate data from received signals and can communicate with a vehicle controller 72, which can have a processor 98, memory, and a navigation device 70, such as a global navigation satellite system (GNSS) receiver (e.g., a global positioning system (GPS) receiver).

The vehicle controller can directly or indirectly control whether the vehicle travels through the crossing and, if so, a speed that the vehicle travels through the crossing. Direct control can include the vehicle controller, with or without operator intervention, allowing or disallowing the vehicle to travel through the crossing (a Movement Authority).

Indirect control may take the form of one or more signals or notifications output to an operator of the vehicle, via, for example, a human machine interface (HMI) 96 of the vehicle controller, that the vehicle is permitted or not permitted to travel through the crossing and, when the vehicle is permitted to travel through the crossing, a permitted speed that the vehicle may cross the crossing (a Bulletin). The operator can then respond to the signals or notifications by controlling the vehicle accordingly. In one embodiment, the HMI may include notification devices and input devices. The features of the HMI can be selected based on end use parameters and operator needs. The controller may prioritize HMI messages based on determined message characteristics. If a wayside device uses a sensor package to measure an operating parameter of a vehicle, and that measurement is outside of a determined operating range, the controller may both signal the vehicle operator, and may prioritize the signal regarding the operating parameter relative to other signals that the operator may be receiving. The controller may request an acknowledgement of receipt of the signal by the operator. If an acknowledgement is not forthcoming, the controller may escalate the signaling attempt in order to prompt acknowledgement, and/or may initiate other responsive actions. In one embodiment, the controller may signal the vehicle operator through a radio with an audible notice. The controller may construct a digitized verbal message, or may generate some other warning tone, to convey information regarding the wayside device having detected an anomalous operation of the vehicle. Of note, that the use of the term vehicle operator and vehicle here, and throughout, does not imply that the vehicle operator is onboard the vehicle that is being scanned by the wayside device. In one embodiment, the vehicle operator may be disposed in a locomotive while the vehicle in question is a railcar elsewhere in the train pulled by the locomotive.

With regard to visual indicia for the HMI, the wayside device's signal may manifest as a value, an icon, or the like on a display screen used by the vehicle operator. The indicia may be controlled so that anomalous behavior is highlighted, or an attention-grabbing effect is used (flashing signals, increased font size and weight, color changes, and the like). In one embodiment, non-anomalous behavior may be noted, and this may indicate further a 'freshness' of the data using time, location, and the like. Trend data for the measurements may be available to the vehicle operator through the HMI.

Referencing a route database, and the database having determined profiles along segments of the route, the controller may determine that a current measurement of an operating characteristic of a vehicle may require a responsive action on the part of the vehicle prior to transitioning into a new route segment having a different profile than the one in which the operating characteristic was measured. For example, a vehicle traveling at 20 MPH in a speed limit zone of 20 MPH may have a bearing detected at an elevated, but not critical, temperature. The controller may interact with the track database and determine that an upcoming segment of track has a speed limit of 50 MPH. The controller may respond, for example, by signaling the vehicle to continue to maintain its speed at 20 MPH even when transitioned into the route segment with the higher (50 MPH) speed limit. In one embodiment, the controller issues a Bulletin to restrict speed until the thermal anomaly is cleared (e.g., by visiting a maintenance shop). In another example, the controller may consult the track database and learn that an upcoming route segment has an increased grade, various curves, a low track health, or some other aspect that may cause a vehicle operating with sensed anomaly to be unable to successfully navigate the upcoming route segment, even if it is able to navigate the current route segment.

In one embodiment, the wayside communication device (communicatively coupled to the wayside device) can be positioned proximate the route and can include a controller 80, which may have a processor 82, a memory 84, and navigation device 86. The controller may perform one or more of: modulate/demodulate and/or encrypt/decrypt signals, transform data protocols, check validity of the information, check authenticity of the information, and determine whether certain monitored parameters have values within determine threshold value limits. In one example, the communication device may query the type of vehicle and/or the type of communication protocol that would work with the vehicle, and then the communication device may transform or translate information, possibly even instruction sets, into a communication protocol effective for the vehicle prior to sending the information to the vehicle.

During operation of the vehicle control system shown in FIG. 2, the first portable communication device 26 can be used by a line crewman who is positioned proximate the crossing. In another example, a plurality of wireless devices (26-1, 26-2) can be controlled by a plurality of line crewman positioned proximate the crossing.

In one embodiment, the portable communication device can transmit data that the crossing is clear, or not clear, for the passage of the vehicle through the crossing. In one example, the system may treat the crossing as 'not clear' unless and until receiving an affirmative signal otherwise. In one embodiment, the communication device can receive the data transmitted by another communication device, and the received data can be provided to the vehicle controller. The vehicle controller may determine whether to control the vehicle to travel or not to travel through the crossing or over a route segment based at least in part on the received data.

In an example, if the data received by the vehicle controller from the vehicle communication device indicates that the crossing or route segment is clear for the passage of the vehicle therethrough, the vehicle controller can directly or indirectly control the vehicle to travel through the crossing or route segment. Prevention of the vehicle from traveling through the crossing may include withholding a Movement Authority, applying the vehicle brakes, by reducing or eliminating the power applied by an engine of the vehicle, or a combination thereof. With reference to the application of brakes, the controller may prevent application of brakes in certain circumstances. And, with ECP, the controller may prevent application of brakes in a particular car that has been determined to have an operating characteristic outside of a determined range. In one embodiment, the controller may determine to use friction brakes, dynamic braking, or both based at least in part on the nature of the detected anomaly, the degree of severity of the detected anomaly, the grade or terrain, environmental factors, the speed of the train, the amount or type of cargo in railcars in the train, the type of locomotive (or locomotives if in a distributed power set up), the placement of the railcar with the detected anomaly in the train, the placement of the locomotives in consist in the train, and the like. In a distributed power system, the controller may determine to brake one locomotive differently relative to another in the consist. The controller may choose to use one type of braking in one locomotive, and another type of braking (or no braking) in another locomotive in the consist. The controller may choose to apply braking at different times, at different rates, and with different rail vehicles.

In one embodiment, where the vehicle controller determines that at least one portable communication device is transmitting data that the crossing or route segment is clear for the passage of the vehicle therethrough and the vehicle is in good working order, the vehicle controller can allow or cause the vehicle to travel through the crossing or route segment. The instruction may be to proceed at less than rated track speed (a Bulletin). There may be information about the crossing or route segment, such as the presence of standing water; degradation of track, ballast, or grade; the proximity of maintenance crews, and the like. In one embodiment, where the vehicle controller receives data.

In one embodiment, the portable communication device can include the HMI functionality such that pressing a single button indicates one or more of: there is a person present; a crossing is clear; a crossing is occupied; a route segment is clear; a route segment is occupied; a route segment is damaged; a route segment is impassable; a route segment warning to go slow; and the like. Variations and permutations can be selected with reference to end use requirements. As an example, a line crewman can indicate to the vehicle controller his presence in the crossing by activating the user present button of the portable communication device. Moreover, in an example, when the line crewman determines, e.g., via visual observation, that the crossing is clear for the passage of the vehicle to pass therethrough, said line crewman can actuate the crossing clear button of the portable communication device. In one embodiment, the portable communication device is detected by a wayside system, which automatically makes the call to stop or slow an incoming vehicle. There may be an override function on the portable device that can be accessed by the line crewman. The route segment, or crossing, may be substantially smaller than the block of route for which a Movement Authority from a back office system may grant permission to travel. In one embodiment, a determined short distance along the route segment (such as near a crossing) may be the only location for which the "user present" function would slow or stop the vehicle system's travel.

In an example, upon receiving data that the user present button and the crossing clear button of only a single the portable communication device present proximate the crossing are both activated, the vehicle controller can slow the vehicle through the crossing at less than rated track speed or stop the vehicle altogether. A vital approach takes the failsafe method, where the behavior of the vehicle (under the influence of the vehicle controller) acts in manner designed to enhance safety and the vehicle does not advance unless safety is assured. In the case of a conflict with one portable device signaling clear, and another signaling that a line crewman is present, the vehicle would resort to a safe posture of not advancing.

In one embodiment, when first and second wireless devices may be positioned proximate the crossing, the portable devices can communication with each other directly or via wayside system (which may act as a signal router, booster, etc.). In an example, the first and second portable devices can respond to a line crewman activating the notice button on of one the portable communication device and the portable communication device can output a wireless notice or alert that can be received by another portable communication device. This may be used to notify other line crewman in the area.

In one embodiment, the distance can be determined by the vehicle controller with reference to GPS data from the navigation device. By comparing the present location of the vehicle to a track database it may be possible to determine distance to a crossing (or route segment) and a time of arrival there at based at least in part upon the speed of the vehicle. The track database may include a map of the route that is used by the vehicle controller to track the movement of the vehicle system on the route. The map of the route may include coordinates of at least some objects on or proximate to the route, including for example, the coordinates of the crossing.

In another example, the wayside communication device can be positioned proximate the crossing or route segment, and the distance between the vehicle and the crossing or route segment can be based on coordinates determined from GPS data output and the known coordinates of the wayside system, such as a balise or other beacon.

Figure 3:
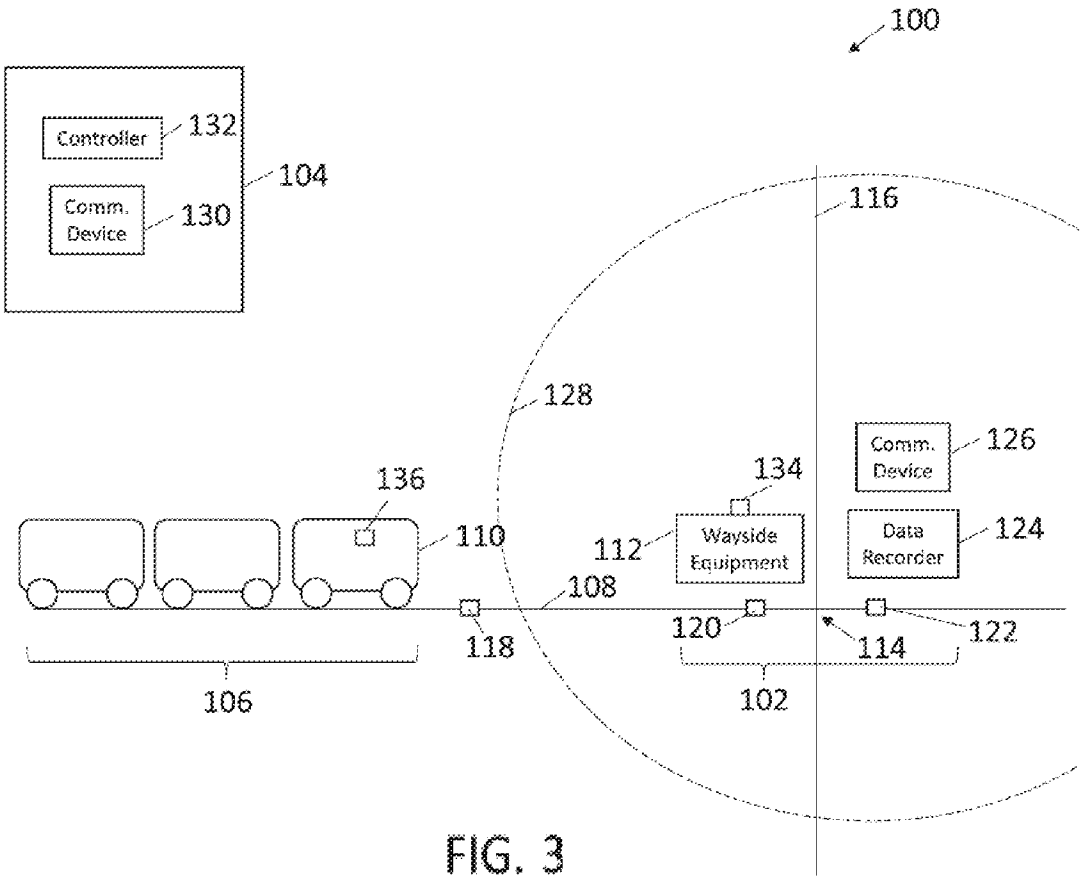
FIG. 3 is a diagram showing an example of a system according to an embodiment of the inventive subject matter.

FIG. 3 is a diagram that illustrates an example of a wayside device monitoring system 100 according to the inventive subject matter. The monitoring system can allow for data to be collected by a wayside device 102 and communicated to a remote system 104 that is remotely located from the wayside device via one or more vehicle systems 106. In one example, the remote system may be a back office system. Suitable back office systems may include a positive vehicle control system, a dispatch system, a vehicle yard and/or control tower, or another system that monitors operation of one or more wayside devices. The wayside device can represent equipment installed alongside a route 108 to support operations, safety, and/or control of vehicle systems.

The vehicle system can represent a single vehicle 110 or two or more vehicles traveling together along one or more routes. With respect to the two or more vehicles, the vehicles in the vehicle system may be mechanically coupled with each other (e.g., by couplers, hitches, etc.), or may be mechanically separate but logically coupled with each other in that the vehicles communicate with each other to travel along the route(s) together as a convoy, platoon, or the like. The vehicle system can include one or more propulsion-generating vehicles capable of propelling themselves (e.g., locomotives, automobiles, trucks, buses, etc.) and optionally one or more non-propulsion-generating vehicles that are incapable of propelling themselves. Suitable non-propulsive vehicles may include one or more of rail cars, trailers, hoppers, gondolas, tankers or tank cars, box cars, flat bed cars, MoW cars, intermodal cars, specialty cars, stack cars, fuel tenders, battery tenders, and auto-rack cars. These non-propulsive cars may be equipped or unequipped. And, some types of cars may be further specialized, such as a refrigerated car, passenger car, and the like; and may have onboard sensor packages (with or without a communication functionality), ECP brakes, and the like.

The wayside device can include one or more wayside component 112. Suitable wayside components can perform one or more functions or operations. One example of a wayside component can be a crossing gate that raises or lowers. The crossing gate may prevent (or allow) vehicle systems to enter and pass by or through a wayside location or area 114. In one example, the wayside location or area is (or includes) an intersection between the route and at least one other route 116. A suitable intersection may be between routes of the same type (e.g., two or more rail tracks, two or more roads, etc.) or between routes of different types (e.g., a rail track and a road). Different types of routes may indicate which vehicle systems can travel on a route. A route of a first type (e.g., a rail route) may be traveled upon by rail vehicles, but not automobiles, trucks, etc. A route of a second type (e.g., a road) may be traveled up on by automobiles, trucks, etc., but not rail vehicles. Alternatively, the wayside location may not include an intersection or crossing but may be the location of a wayside device that is not at or near an intersection or crossing. In another example, the wayside location or area is a route segment that does not include an intersection or crossing.

Other wayside component can include a notification signal or a switch or joint. The notification may indicate status of the route to the vehicle systems, a health (or problem) with the vehicle system, or both. The route status can indicate whether the segment of the route ahead (e.g., downstream of the wayside device along the direction of movement of the vehicle system) is clear, occupied, or restricted. The switch or joint may be disposed at an intersection and can control the direction that vehicle systems move while passing through the intersection. For example, in a first state or condition, a switch or switch point may cause a vehicle system traversing or traveling over the switch or switch point to stay on the route and not enter onto the route. In different, second state or condition, the same switch or switch point may cause the vehicle system traversing or traveling over the switch or switch point to move from one route to another. Another example of wayside component can include a travel interruption device. These types of wayside component can operate to intentionally or purposefully move a vehicle system off the route, such as by derailing a rail vehicle system, moving the vehicle system onto a siding or other route, etc.

Another example of wayside component can include a location and/or movement detector of vehicle systems on the routes. These types of wayside component can detect the presence of vehicle systems, the direction in which the vehicle systems are moving, unique identities or identifiers of the vehicle systems, etc. Another example of wayside component can include a route circuit that includes one or more electrical circuits that detect the presence of a vehicle system on a segment of the route. These types of equipment can detect the presence of the vehicle system responsive to the wheels, axles, chassis, etc. of the vehicle system creating a short across parallel rails of the route.

Another example of wayside component can include one or more sensors that can detect and monitor various characteristics of the vehicle system and/or the surrounding environment. For example, the wayside component can include a hot bearing detector for measuring a temperature of a vehicle axle, a speed sensor measuring how fast the vehicle system is moving, a camera that detects and/or identifies the vehicle system, an acoustic sensor that may detect wheel defects or growling bearings, ambient temperatures, ambient pressures, ambient humidity, and the like. Other suitable wayside components, such as sensor packages, are disclosed herein.

In the illustrated example, the wayside component can monitor a route segment or a crossing gate and can detect the approach, passage through, and/or exit of a vehicle system through the segment and/or through the crossing. At the same time, the sensor package may inspect the vehicle for damage, failures, performance, and the like. The wayside component may query and communicate with an onboard controller, which may be able to communicate with onboard sensors if available. The wayside component can include or be connected with route circuits 118, 120, 122 that are shunted or short circuited responsive to passage of a vehicle system over or through the corresponding circuits. Detection of this short or shunt can be recorded by a data recorder 124 of the wayside device and/or can be communicated to a back office and/or to the vehicle itself. The communication may be selective, in one embodiment, with lesser important messaging going to the back office, and greater important messaging going to the vehicle, at least.

The wayside component can obtain and/or generate the data that is stored by the data recorder. For example, the wayside device can detect the presence of the vehicle system using the route circuits, can identify the vehicle system by communicating with the vehicle system (to obtain a unique identifier or road number associated with the vehicle system), and/or can determine the time(s) at which the circuits detect the vehicle system. These times can indicate when the vehicle system approaches the intersection by passage of the vehicle system over the approaching circuit, when the vehicle system enters the intersection by passage of the vehicle system over the first island circuit, and/or when the vehicle system leaves the intersection by passage of the end of the vehicle system over the second island circuit.

Suitable wayside component can include or represent a gate or other object that lowers or raises to create a physical barrier. This barrier may dissuade or prevent vehicle systems from crossing or entering the intersection while another vehicle system approaches and/or is passing through the intersection. The wayside component (e.g., the processor(s)) can direct the data recorder to record data indicative of whether the gate is properly operating (e.g., the gate lowers or raises on command), whether the gate is not properly operating (e.g., the gate does not lower or raise on command), or the like. Optionally, the wayside device can record other data, such as the times at which the signal is activated, the duration that the signal is activated, the color of the light generated by the signal, whether the signal was or was not activated upon command by the processor(s), the state or condition of the switch or switch point at different times, times at which the switch or switch point changes state or condition, the detection of vehicle systems, the identities of the vehicle systems, the directions of movement of the vehicle systems, the speeds of the vehicle systems, the state of the traffic interruption device, the time at which the traffic interruption device is activated to change movement of a vehicle system, the sensed characteristics of the vehicle system, the sensed characteristics of the environment, etc.

The wayside device may include or be connected with a communication device 126. A suitable communication device may wirelessly communicate with one or more other communication devices. The communication device can represent transceiving circuitry, such as one or more antennas, modems, or the like. The communication device can represent a WiFi or other wireless access point that allows the wayside device to communicate with the vehicle systems passing through the intersection or passing by the wayside device. Optionally, the communication device can represent a radio transceiver, a cellular transceiver, a BLUETOOTH transceiver, a ZIGBEE transceiver, a Near Field Communication (NFC) interrogator or receiver, a radio frequency identification (RFID) interrogator or receiver, or the like. In one embodiment, the communication device may use a wire or fiberoptic to communicate data. A suitable wayside device may include both a sensor package and a communication package. Suitable sensors may include one or more of an optical sensor, an acoustic sensor, a magnetic sensor, as well as others described herein and selected based at least in part on the end use requirements. In one embodiment, the sensor package may include one or more electronic readers (e.g., RFID readers) that can communicate with tags or labels associated with various vehicles.

The communication device can be built into, or retrofitted to, the wayside device. For example, the communication device can be added to a pre-existing or previously installed wayside device and/or data recorder to permit communication of data between the wayside device or data recorder and the vehicle system(s). For example, the communication device can be taken to and connected with a data recorder of a wayside device that previously was operating as described herein, but where the wayside device previously was unable, not configured, or incapable of wirelessly communicating data prior to installation of the communication device.

The wayside component can record the data as the vehicle systems pass by the wayside component, and then wirelessly communicate the data to one or more of the vehicle systems as the vehicle systems pass by the wayside component. For example, instead of waiting for an operator to drive to the wayside device to connect to and download the data from the data recorder, the wayside device can wirelessly communicate the data to one or more of the vehicle systems passing through or near (e.g., within a wireless communication range of) the wayside device. The communication device of the wayside device may be unable to communicate the data directly to the remote system due to the remote system being farther from the wayside device than a wireless communication range of the communication device of the wayside device. Instead, the wayside device communicates the data to the vehicle system(s) passing within a communication range 128 of the communication device of the wayside device. In one embodiment, the wayside device is communicatively coupled to a communication bus or network. This may be wired (electrical wiring or fiber optic) or wireless (radio, cell, sat-link). The vehicle system may communicate directly with the wayside device in some embodiments, and in other embodiments may communicate indirectly (via the communicate bus or network).

The vehicle system(s) receiving this data may pass through the intersection or section of the route that is monitored or controlled by the wayside device. Optionally, the vehicle system(s) receiving the data from the wayside device may not pass through the intersection or section of the route that is monitored or controlled by the wayside device but may pass close enough to the wayside device (e.g., on a nearby route) to receive data.

The vehicle system(s) may include communication devices that can receive the wayside device data. These vehicle system(s) may then communicate the data to the remote system. For example, the remote system may include a communication device 130 that represents wireless transceiving hardware for communicating with the vehicle system(s). The remote system may include a controller 132 (e.g., a remote system controller) that represents hardware circuitry including and/or connected with one or more processors that operate as described herein in connection with the remote system. Once the vehicle systems move to within a communication range of the remote system, the vehicle systems can communicate the wayside device data to the remote system. The remote system may be a back office system having regular communication abilities with the vehicle systems, but not with the wayside devices. The vehicle systems may be able to communicate with the back office system once the vehicle systems receive the data from the wayside device. Optionally, the vehicle systems can communicate the data to the remote system once the vehicle systems return to a wired network connection with the remote system, such as in a vehicle yard.

This can allow for the data collected or generated by the wayside device to be communicated to the remote system on a more regular basis than currently known wayside devices. If a fault, deterioration, or failure arises with operation of the wayside device, the data indicative of the fault, deterioration, or failure may be communicated to the remote system sooner than if the data was communicated only when an operator drives to the wayside device, downloads the data, returns to the remote system, and uploads the data to the remote system.

The remote system may include or represent hardware circuitry having or connected with one or more processors that examine the data from the wayside device. The remote system can examine the data to evaluate the state of the wayside device and, if needed, implement one or more responsive actions. For example, the remote system may examine the data and determine that the wayside component is not operating correctly. The remote system may send an operator to repair or inspect the wayside component responsive to determining that the wayside component is not operating correctly. Alternatively, the communication device of the wayside device may include a cellular transceiver that allows the wayside device to communicate the data to the remote system without passing the data to the remote system via one or more of the vehicle systems first.

The data optionally may be examined by the remote system to recreate or evaluate one or more events occurring in connection with the wayside device. For example, the data containing the times at which vehicle systems entered into and/or passed through the intersection, the times at which the gates lowered or raised (or did not move), etc., may be used to recreate the events leading up to and/or following a collision or other accident at or near the intersection.

The entirety of the data communicated from the wayside device to the remote system via the vehicle system(s) may not be communicated to only a single vehicle or a vehicle system before being forwarded to the remote system. For example, the size of the data to be communicated to the remote system may be too large and/or the bandwidth of the wireless connection between the wayside device and the vehicle system(s) may be too limited to permit all of the data being communicated to the remote system to be communicated to a single vehicle system passing the wayside device. Instead, different portions or segments of the data may be communicated to different vehicles or different vehicle systems. For example, a first portion of the data stored in the data recorder may be communicated to a first vehicle of a vehicle system, a second portion of the data stored in the data recorder may be communicated to a second vehicle in the same vehicle system, and so on. As another example, a first portion of the data stored in the data recorder may be communicated to a first vehicle system, a second portion of the data stored in the data recorder may be communicated to a second vehicle system (that is separate from the vehicle first vehicle system), and so on. The different portions of the data may be non-overlapping portions in that no data included in one portion of the data also is included in another portion of the data. Alternatively, at least some of the data in one portion also is included in another portion of the data. The different portions of the data may be non-overlapping portions in that no data included in one portion of the data also is included in another portion of the data. Alternatively, at least some of the data in one portion also is included in another portion of the data.

The wayside device can communicate the data to vehicle systems only after identifying and confirming the identity of the vehicle systems in one example. For example, the wayside device may only communicate the data to vehicle systems owned or operated by the same company, entity, or the like, that operates the wayside device, to vehicle systems that are designated subscribers to receive the data (e.g., have previously signed up or otherwise indicated a desire to receive the data), etc. The identity of the vehicle systems may be communicated to the wayside device, and the wayside device can determine (based on stored identities in the data recorder) whether a vehicle system is or is not permitted to receive the data. The wayside device may then communicate (or not communicate) the data to the permitted vehicle systems.

The wayside device optionally may include a signal device 134 that can indicate a state or condition of the wayside component. For example, the signal device may be one or more lamps that generate one or more lights to indicate whether the wayside component is operating as expected (e.g., generate a green light), is operating with one or more faults (e.g., generate a yellow light), or is not operating (e.g., generate a red light). The vehicle system may include a sensor 136 that can detect the indicator generated by the signal device. For example, the sensor may be a camera, radio frequency (RF) sensor, photovoltaic cell, or the like, that can sense whether a lamp is activated by the wayside device and/or the color of the light generated by the lamp of the wayside device. This can permit the vehicle system to communicate the status of the wayside device to the remote system.

Figure 4:
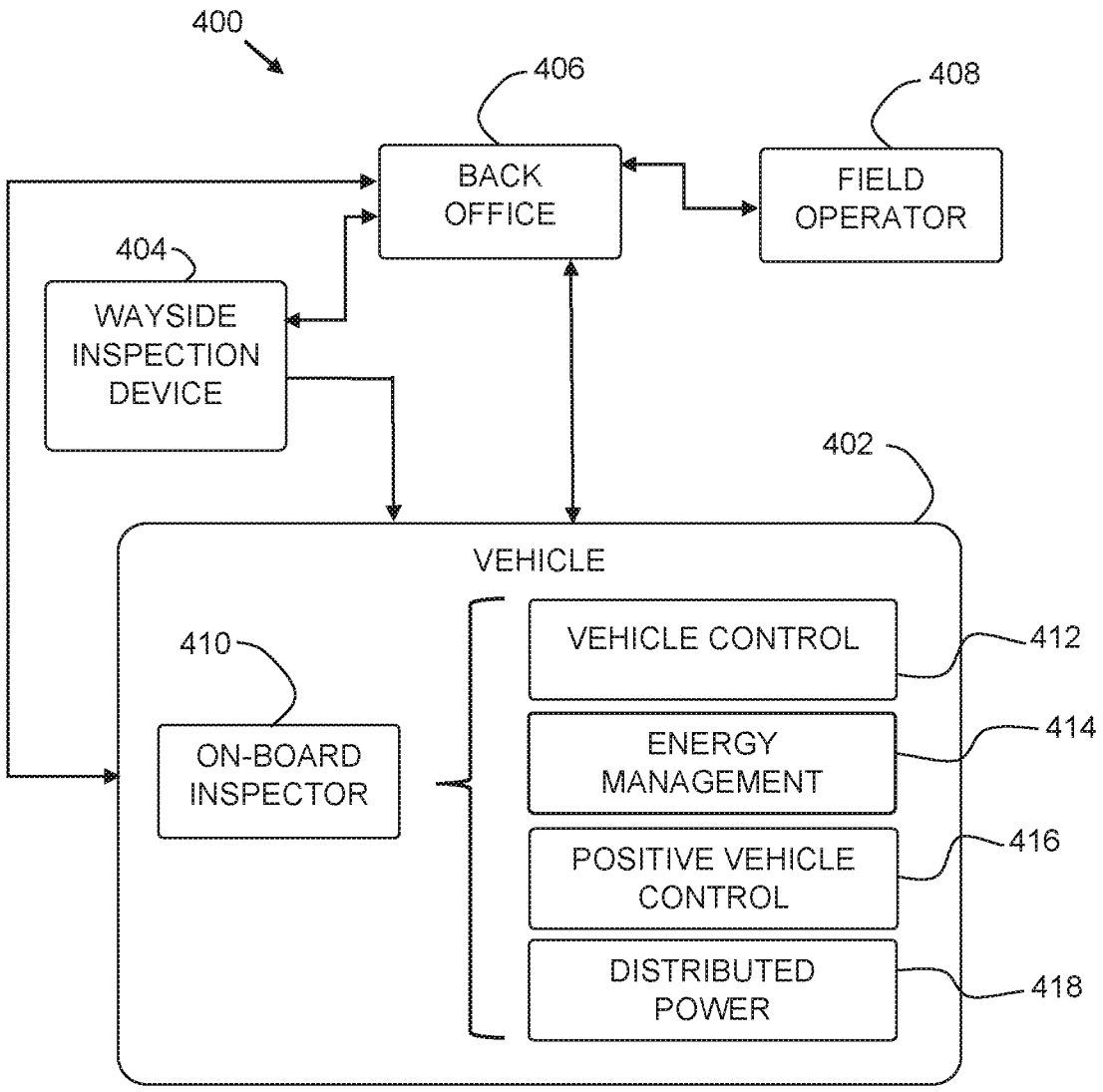
FIG. 4 is a block diagram showing an example of a system according to an embodiment of the inventive subject matter.

With reference to FIG. 4, a diagram showing a system 400 having an embodiment of the inventive subject matter is shown. The system may include one or more vehicles 402, a wayside inspection device 404, a back office system 406, and a field operator 408. The vehicle may have one or more onboard inspector device 410. The vehicle may have one or more of a vehicle control device 412, an energy management system 414, a positive vehicle control system 416, and a distributed power system 418. During operation, the onboard inspector, the wayside inspector, or both may detect an operating parameter that is determined to be within (or outside of) a determined threshold value associated therewith. Similarly, a field operator that is proximate to the operating vehicle may sense, observe, or measure the operating parameter and determine whether it is within (or outside of) a determined range. In one embodiment, the inspector, inspection device, and/or the field operator convey information about the operating parameter to a back office, to the vehicle directly, or both. The back office may issue a Bulletin to the vehicle based as least in part on the conveyed operating parameter information. Alternatively or additionally, the back office may rescind or withhold a Movement Authority based at least in part on the conveyed operating parameter. The Bulletin and/or Movement Authority may be communicated to the vehicle, or to a vehicle in the same vehicle system. In one embodiment where the operating parameter is communicated directly to the vehicle, including where the onboard inspection device is already aboard the vehicle, the Movement Authority and/or Bulletin are conveyed to the onboard Positive Vehicle Control device. Alternatively or additionally, the Movement Authority and/or Bulletin are conveyed to the vehicle controller, the energy management system, and/or the distributed power system. The vehicle controller may respond to the receipt as described herein.

In various embodiments, information on an operating parameter from sensors about a component on a vehicle (or on a vehicle that is in a vehicle system) is generated and reported ultimately arriving at the vehicle controller. That operating parameter can be conveyed in a raw form, or can be analyzed at a step along the transfer to determine if a threshold level has been meet and/or if the operating parameter is in (or outside of) a determined range. Upon the determination, the system may simply forward information in the form of a binary determination, such as "out of range", and/or the determination may be one of degree. A degree may be "slightly out" or "very out" of range, such that the response from the system may differ depending on the degree.

Suitable optical sensors may include an optical geometry sensor, an Infrared (IR) sensor such as a hot box or hot wheel bearing detector, a sensor package for tracking behavior (geometry) and tracking stability (hunting) of wheelsets and bogies, and the like. With regard to sensing tracking position defects, these may include head checking and gauge-corner cracking, as well as rail head cracking from shelling and longitudinal fatigue; and angle-of-attack defects relate to intermittent crown wear as lateral material flows, lateral fatigue cracking that can lead to rail breaks, and surface breaking cracks that can develop into rail squats, hunting defects may lead to a combination of wear patterns, in particular, repeated flange impacts and scrubbing wear actions against the rail. Other optical sensors may include laser scanners, such as the available from Wabtec Corporation.

With regard to acoustic sensors, suitable systems may be commercially available as KinetiX monitoring system, a component of which is the Track IQ system, from Wabtec Corporation. KinetiX may include the RailBAM system, which is a "Bearing Acoustic Monitor" (BAM) that can monitor the acoustic signature of each axle bearing passing the system at line speed. RailBAM technology can accurately and reliably identify the presence of defects in bearings. RailBAM can rank the bearing severity and fault type. In some cases, RailBAM can detect problem bearings in advance of heat generation caused by a bearing defect. A principle of operation for RailBAM's is analyzing sound characteristics, such as those emitted by bearing faults, wheel impacts, gearing operation, and the like. A bearing fault may excite a structural response in the bearing and the sound radiated from the housing is sampled. Proprietary signal processing techniques allow the bearing fault signal to be isolated other noise (e.g., wheel noise), enabling fault identification and classification. Bearings that can be monitored may include axle bearings, traction motor bearings, gearbox bearings, and the like. Other monitorable components may include brake systems (including brake pads and shoes), the engine, the horn, wheel round/true, and the like. Suitable sensor packages may include one or more of Wheel Impact Load (WILD), Truck Performance Detectors (TPD) and Truck Hunting Detectors (THD). Other suitable sensor packages may include one or more of Truck Performance Detectors (TPD), Truck Alignment Detectors (TAD) and Acoustic Bearing Detectors (ABD). Yet other suitable sensor packages may include one or more of Hot Box Detectors (HBD), Wheel Profile Measurement System (WPMS), and Dragging Equipment Detector and Low Air Hose Detectors. The sensor packages and their corresponding wayside component may be selected with reference to end use applications and operating parameters. In one embodiment, the wayside device may detect a loose wheel or wheelset.

In one embodiment, the controller receives information from the wayside regarding the health of a vehicle and determines there is an operational parameter that is measured outside of a determined threshold range. A feature of the controller is that in addition to whatever other responsive measures it may take, the controller engages the communication device to provide notice and information to local or regional emergency response agencies. In an embodiment, the system may differentiate between types of vehicles, or types of cargo on the vehicle (such as by comparing a vehicle ID to a manifest or the like). For example, if the controller detects a hot bearing on a vehicle passing by the wayside device, the controller may check by vehicle type (such as a bulk liquid tanker) or manifest to determine if the cargo is hazardous in some way. If the cargo is determined to be hazardous (such as the cargo having been tagged with a hazardous cargo designation previously, or its cargo is on a hazardous cargo list, or is not on a non-hazardous cargo list) then a notice is sent to the emergency response agency. Additional information may be provided, as well, such as quantity of hazardous material, type of hazard, type of hazardous material, other materials (type and quantity) listed in the manifest for the vehicle system, direction of travel, speed of the vehicle system, and the like.

In one embodiment, the system may alert emergency first responders of a scheduled travel of a vehicle system carrying hazardous cargo regardless of the detection of a mechanical issue being detected by the wayside device. The alert may include the intended arrival time, the type of vehicle(s), the type of hazard, the type of hazardous material, the quantity of hazardous material, the route and speed that is planned, and the departure time from the region of the vehicle system. Pre-loading the information with the emergency responders may then allow for more efficient response as they information is present with them in the case of a mechanical failure being detected by the wayside device and reported to the emergency responders. They may then be able to anticipate deployment of resources and the location to which they may deploy in a relatively timely manner. In one embodiment, the alert is pushed to determined individuals. In one embodiment, the alert is posted to a networked HMI (e.g., a webpage) such that a user may check the webpage to obtain information from the alert.

In one embodiment, the wayside devices are disposed along the route at determined intervals. In one embodiment, the interval is in a range of from about five miles to about 9 miles apart, from greater than about 9 miles to less than about 11 miles apart, or greater than about 11 miles apart. In another embodiment, the interval is in a range of from about 20 miles to about 50 miles apart. In one embodiment, the interval is determined based on various environmental factors such that, for example, in high population areas the intervals are closer together than in low population areas. Other factors may include traffic density, likelihood or frequency of hazardous cargo loads, the communication reach of various communication equipment, and the like. Economic considerations may play a role, both for initial capital cost for equipment and installation but also for upkeep and maintenance of installed equipment. Determinations about interval selection may be made with reference to application specific requirements. As such, interval selection is less likely to be arbitrary, and determined interval selections involve tradeoffs and risk evaluations.

With the periodic checking on the operating parameters of vehicles in the vehicle system, the controller may associate plural readings for a particular vehicle over time and distance. The controller may then, optionally, establish a baseline for each vehicle and then compare future readings against that baseline to determine if there are anomalies in its operation. This may allow for determinations both against absolute standards, as well as relative standards for specific vehicles. The controller may then, optionally, determine trendlines for incremental changes in operating behavior over time. As such, slow increases in heat over time and/or distance may signal that a component on the vehicle is failing, but may not yet have failed. This allows for responsive actions prior to failure. That is, predictive determinations may allow for responsive actions. These actions may include changing an operating mode of the vehicle, stopping the vehicle, routing the vehicle for maintenance rather than having it complete its mission, re-routing the vehicle to less populated areas, and the like. The responsive actions may be, in one embodiment, based at least in part on the failure mode that is anticipated, the type and quantity of the cargo (hazardous, yes, or no), the vehicle type and the available operating modes. As an example, if a traction motor bearing is heating up over time, but is not yet hot enough to indicate a failure, the vehicle control system may cut out the traction motor or may use it at reduced power. The traction motor can be further monitored by subsequent wayside devices to determine if the traction motor bearing continue to get hotter or if they have stabilized or are even cooling.

Figure 5:
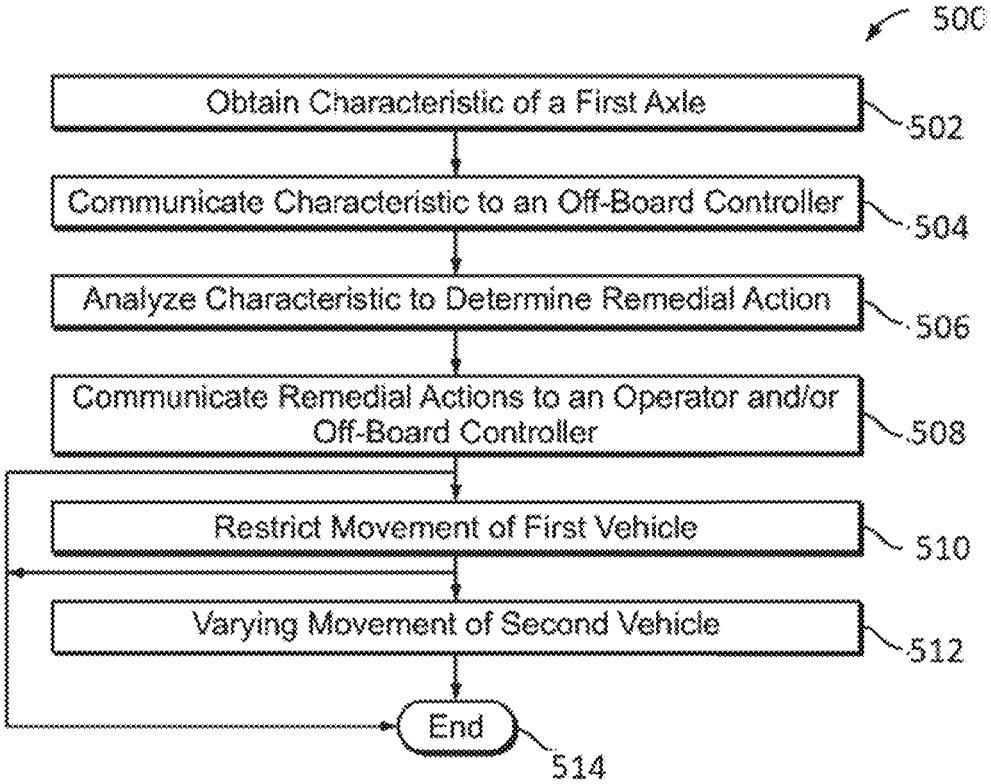
FIG. 5 is a block diagram flowchart showing a method according to an embodiment of the inventive subject matter.

With reference to FIG. 5, a block diagram is provided that illustrates a method 500 according to an embodiment of the inventive subject matter. The method starts where a characteristic of a first axle is obtained at step 502. The characteristic may be an operating parameter of the first axle. The first axle may be on a trail rail car in a train being pulled by a second vehicle, such as a locomotive. In this example, the sensor package is onboard the first or second vehicle. At step 504 the characteristic may be communicated to an off-board controller. The off-board controller may be a back office, or may be an edge device located, for example, in a wayside device. At step 506, the characteristic may be analyzed to determine a remedial action. The remedial action(s) may be communicated to a vehicle operator and/or to the vehicle controller onboard the vehicle at step 508. If the communication is to the vehicle controller, then optionally the vehicle controller may initiate the remedial action; and, if the communication is to the vehicle operator they may decide to implement the remedial action. Regardless of the actor, if there is a remedial action to be taken then at step 510 the movement of the first vehicle is restricted. This may be accomplished by varying or changing the movement of the second vehicle at step 512. Upon remediation responsive to the detected characteristic, the method ends at step 514.

In various embodiments of the above-disclosed method, the locomotive's movement is varied, i.e., controlled, through the positive vehicle control system, the energy management system, the distributed power system, and the like. For example, the vehicle control system detects anomalous behavior (e.g., bearing growl, increased drag, vibration patterns, thermal excursion readings, and the like) and sends information to that effect through a communication network to the back office. The back office determines that there is an existing or imminent failure and sends back, via the positive vehicle system, a Bulletin to stop or slow the vehicle system. The vehicle responds by slowing to a stop in a safe and controlled manner. Appropriate equipment and resources can be dispatched to the location of the vehicle to address the anomalous behavior. Also, if there are vehicle operators, they can be notified to check on the anomalous behavior. For example, the vehicle operators can be notified that rail car number "twenty second in the line" has been detected with a hot axle, and they can inspect that vehicle for that mechanical issue.

In one embodiment, the monitoring system may have a local data collection system deployed in the remote system that may use machine learning to enable derivation-based learning outcomes. The remote system may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the remote system may represent or include a policy engine that may apply one or more policies. These policies may be based at least in part on characteristics of a given item of equipment or environment. With respect to control policies, a neural network can receive input of a number of environmental and task-related parameters. These parameters may include the data obtained from the wayside device, such as identifications of vehicles approaching and/or passing the wayside device, times at which the vehicles were identified, times at which the wayside device changed state or condition, times at which a fault or failure of the wayside component was detected, etc.

The neural network may be included in the remote system and can be trained to generate an output based on these inputs, with the output representing an action or sequence of actions that the vehicle systems, remote system, and/or wayside device should take. For example, the neural network can direct or send signals to remotely control one or more of the vehicle systems (e.g., to change routes to avoid faulty or failed wayside component, to slow down to permit an operator to travel to and/or repair the wayside device, etc.), to remotely control the wayside device (e.g., to change a state or condition of the wayside component), to direct an operator to travel to and repair or inspect the wayside device, etc. During operation of one embodiment, a determination can occur by processing the inputs through the parameters of the neural network to generate a value at the output node designating that action as the desired action. This action may translate into a signal that causes the remote system, wayside device, and/or vehicle system to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The monitoring system may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the remote system executes that plan to achieve the desired input data to mirror the predicted best outcome scenario. Additionally, the success metric may be a combination of the optimized outcomes, which may be weighed relative to each other.

The monitoring system can use this artificial intelligence or machine learning to receive input (e.g., wayside device data), use a model that associates locations with different operating modes to select an operating mode or change in state/condition of the wayside device, and then provide an output (e.g., the change in operation of the wayside device and/or vehicle system using the model). The monitoring system may receive additional input of the change in operating mode that was selected, such as analysis of noise or interference in communication signals (or a lack thereof), operator input, or the like, that indicates whether the machine-selected operating mode provided a desirable outcome or not. Based on this additional input, the controller can change the model, such as by changing which operating mode would be selected when a similar or identical location or change in location is received the next time or iteration. The controller can then use the changed or updated model again to select an operating mode, receive feedback on the selected operating mode, change or update the model again, etc., in additional iterations to repeatedly improve or change the model using artificial intelligence or machine learning.

During operation, the vehicle system and/or the wayside system may send data to a back office, such as a PVC system, for use in evaluating functionality or health of the wayside device, the vehicle, or both. The remote system can use this data to determine if components are not functioning and, as a result, change how one or more vehicles can move. For example, the remote system can communicate movement authorities or bulletins to indicate restrictions on how and/or when vehicle systems can travel in different segments of a network of interconnected routes. These authorities/restrictions may prevent a vehicle from entering a route segment or crossing; or from passing the wayside device, may increase separation distances between vehicle systems, may prevent vehicle systems from entering an intersection too close in time to another vehicle system, may initiate a controlled stop of the vehicle system, and this all may be based at least in part on the identification of how a wayside device or a vehicle is, or is not, operating. A vehicle with a sparking DC traction motor and another vehicle with a hot bearing and yet another with a bearing that has fully failed may all be controlled differently relative to each other. The grounding DC traction motor example may have that traction motor cut out or may have its voltage limited. The vehicle with the hot bearing may be slowed, and by way of contrast the vehicle with the failed bearing may be stopped. Other examples illustrating the point involve detection of the health of an engine, leaks from a fuel tender, a rail car that is hunting severely enough that it can be predicted to derail, and so on.

In one embodiment, the wayside device (directly or via the back office) may communicate a signal to vehicle operators. The signal may identify a problem with a vehicle in the vehicle system, identify which vehicle of the vehicle system has the problem, indicate a severity of the problem, indicate an imminence of the problem occurring, indicate a recommended course of action, and the like. Due to potential transmission delays, the signal may include a time stamp. The vehicle operators may then respond to their receipt of the signal with a determined responsive action. In one embodiment, the wayside device (directly or via the back office) may communicate with first responders.

In one example, a wayside device monitoring system is provided that may include wayside component control movement of vehicle systems through a segment of a route and/or monitor operation and health of the vehicle systems. The wayside component can record data indicative of the one or more of controlling movement of the vehicle systems or monitoring operation of the vehicle systems. The monitoring system can include a communication device coupled with the wayside component. The communication device can communicate the data recorded by the wayside component to at least one of the vehicle systems as the at least one of the vehicle systems move by the wayside component.

The communication device may communicate the data to a remote system that remotely restricts movement of the vehicle system by communicating the data to the at least one of the vehicle systems. The communication device can be retrofitted to the wayside component. The wayside component may include a gate that raises or lowers to control access to an intersection. The wayside component may record one or more of an identity of one or more of the vehicle systems, a time at which the one or more of the vehicle systems passed the wayside component, and/or a time at which the wayside component raised or lowered the gate.

The wayside component may communicate the data to a remote system via at least one of the vehicle systems. The wayside component can communicate the data to the remote system via at least one of the vehicle systems while the remote system is outside of a wireless communication range of the communication device. The communication device may wirelessly communicate different portions of the data to different vehicles of the vehicle system as they move by the communication device.

In another example, a method for monitoring operation of a wayside device is provided. The method may include recording data obtained by wayside component (of the health of sensed components, for example) that one or more of: controls movement of vehicle systems through a segment of a route and/or monitors operation and health of the vehicle systems. The data that is recorded can be used to identify failed components and/or predict potential future failures (of which components, and when the failure might occur). The method may include communicating the determination to the vehicle. This may be done as vehicle moves by the wayside component.

The data may be communicated to the at least one of the vehicle systems for communication to a remote system that remotely restricts movement of the vehicle system by communicating the data to the at least one of the vehicle systems. The method also can include retrofitting a communication device to the wayside component. The data may be communicated to the at least one of the vehicle systems using the communication device. The data that is recorded may be associated with (e.g., generated in response to) raising and/or lowering a gate to control access to an intersection. The data may include one or more of an identity of one or more of the vehicle systems, a time at which the one or more of the vehicle systems passed the wayside component, and/or a time at which the wayside component raised or lowered the gate.

The method may include communicating the data from the at least one of the vehicle systems to a remote system. The data can be communicated to the remote system via at least one of the vehicle systems while the remote system is outside of a wireless communication range of the communication device. The data may be communicated by wirelessly communicating different portions of the data to different ones of the vehicle systems as the vehicle systems move by the communication device.

In another example, the wayside device may include a physical barrier, such as a gate that can be raised or lowered, to control access of vehicle systems to move into or through a route segment or through an intersection between routes. There may be a data recorder that can store data indicative of times at which the physical barrier is deployed or put away, that is, when the gate is raised or lowered. A communication device may wirelessly communicate the data to a remotely located back office system by wirelessly communicating the data to at least one of the vehicle systems while the at least one of the vehicle systems moves through the intersection.

The communication device may be initially installed, or may be retrofitted to the wayside device. The communication device can communicate different portions of the data to different ones of the vehicle systems. The communication device may wirelessly communicate the data to the at least one of the vehicle systems subsequent to determining an identity of the at least one of the vehicle systems.

Use of phrases such as "one or more of . . . and," "one or more of . . . or," "at least one of . . . and," and "at least one of . . . or" are meant to encompass including only a single one of the items used in connection with the phrase, at least one of each one of the items used in connection with the phrase, or multiple ones of any or each of the items used in connection with the phrase. As used herein, an element or step recited in the singular and preceded with the word "a" or "an" do not exclude the plural of said elements or operations, unless such exclusion is explicitly stated. Furthermore, references to "one embodiment" of the inventive subject matter do not exclude the existence of additional embodiments that incorporate the recited features.

This written description uses examples to disclose several embodiments of the subject matter, including the best mode, and to enable one of ordinary skill in the art to practice the embodiments of subject matter, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a wayside device configured to detect one or more operating parameters of a vehicle in a vehicle system moving over a route segment; and a processor and a memory storing instructions executable by the processor to cause the processor to:

receive information from the wayside device regarding at least the one or more operating parameters detected, and based at least in part on the information that is received, control the movement of the vehicle to be a natural roll to stop without braking or further propulsion.

2. The system of claim 1, wherein the controller is configured to control the movement of the vehicle based at least in part on the information that is received and based at least in part on one or more of:

a location of the vehicle;

a speed of the vehicle;

a type of cargo on the vehicle;

an amount of the cargo on the vehicle;

an amount of the cargo on plural ones of the vehicle in the vehicle system; or an infrastructure present in a route segment on which the vehicle is moving.

3. A system, comprising:

a wayside device configured to detect one or more operating parameters of a vehicle in a vehicle system moving over a route segment; and a processor and a memory storing instructions executable by the processor to cause the processor to:

receive information from the wayside device regarding at least the one or more operating parameters detected, and based at least in part on the information that is received, control the movement of the vehicle at least in part by a cut out of a propulsive axle in response to the one or more operating parameters being associated with the propulsive axle.

4. The system of claim 3, further comprising a communication device that is configured to communicate the information that is received to a remote back office system that is configured to remotely restrict the movement of the vehicle.

5. The system of claim 3, wherein the controller is configured to generate a signal and communicating the signal to an operator of the vehicle.

6. The system of claim 3, wherein the controller is further configured to communicate with a back office system, and to receive a bulletin or command to restrict the movement or speed of the vehicle from the back office system.

7. The system of claim 3, wherein the controller is configured to determine an identity of the vehicle and associate the information that is received with the vehicle.

8. The system of claim 3, wherein the wayside device comprises a sensor package, and the sensor package comprises at least one of a thermal sensor, an acoustic sensor, a laser scanner, a video camera, or an impact sensor.

9. The system of claim 8, wherein the sensor package is configured to measure a temperature of a vehicle component as the vehicle passes by the wayside device.

10. The system of claim 9, wherein the controller is configured to determine whether the vehicle has one or more of an axle, a bearing, or a motor that has a temperature that is above a determined temperature threshold value, and the temperature is included in the one or more operating parameters.

11. The system of claim 8, wherein the controller is configured to determine whether the vehicle is emitting a bearing growl, and a presence of the bearing growl that is detected is included in the one or more operating parameters.

12. The system of claim 8, wherein the controller is configured to determine whether there is an impact signature that matches a determined signature profile, and a presence of the impact signature is included in the one or more operating parameters.

13. The system of claim 3, wherein the controller is configured to control the movement of the vehicle to be a slow and light braking effort to stop.

14. The system of claim 3, wherein the controller is configured to assign the vehicle or determine a vehicle identification code, and the controller is configured to assign plural readings of the one or more operating parameters of the vehicle from plural ones of the wayside device over one or more of time or distance, and the controller is configured to determine a trendline of the one or more operating parameters for the vehicle over the one or more of time or distance.

15. The system of claim 3, wherein the wayside device is disposed proximate to an intersection of two or more routes.

16. The system of claim 15, wherein the wayside device includes a physical barrier to selectively control access to the intersection.

17. The system of claim 3, further comprising at least one sensor onboard the vehicle and that is configured to measure at least a second operating parameter, and to provide the second parameter that is measured to the controller.

18. A system, comprising:

a wayside device configured to detect one or more operating parameters of a vehicle in a vehicle system moving over a route segment; and a processor and a memory storing instructions executable by the processor to cause the processor to:

receive information from the wayside device regarding at least the one or more operating parameters detected, and based at least in part on the information that is received, control the movement of the vehicle based at least in part on a location, and the controller is configured to slow or stop the vehicle in a higher population area differently than in a lower population area.

19. A system, comprising:

a wayside device configured to detect one or more operating parameters of a vehicle in a vehicle system moving over a route segment; and a processor and a memory storing instructions executable by the processor to cause the processor to:

receive information from the wayside device regarding at least the one or more operating parameters detected, and based at least in part on the information that is received, control the movement of the vehicle based at least in part on a cargo type and the controller is configured to determine to slow or stop the vehicle with a hazardous cargo differently than with less hazardous cargo.

20. A system, comprising:

a wayside device configured to detect one or more operating parameters of a vehicle in a vehicle system moving over a route segment; and a processor and a memory storing instructions executable by the processor to cause the processor to:

receive information from the wayside device regarding at least the one or more operating parameters detected, determine which of friction brakes, dynamic braking, or both to respond to a determination of an anomalous operation of a railcar component, determine whether to apply braking of the vehicle system at different times, at different rates, and with different vehicles of the vehicle system; and control movement the vehicle directly based at least in part on the information that is received from the wayside device.

21. The system of claim 20, wherein the controller is configured to control the movement of the vehicle based at least in part on a nature of the anomalous operation that is detected, a degree of severity of the anomalous operation, a grade or terrain, environmental factors, a speed of the vehicle system, an amount or type of cargo in the vehicle system, a type of the vehicle locomotive, a type of plural ones of the vehicles in a distributed power set up, a placement of the vehicle with the anomalous operation in the vehicle system, and a placement of the vehicle in consist in the vehicle system.

* * * * *